US005765730A

United States Patent [19]

Richter

[11] Patent Number: 5,765,730

[45] Date of Patent: Jun. 16, 1998

[54] ELECTROMAGNETIC VALVE FOR CONTROLLING THE FLOW OF MOLTEN, MAGNETIC MATERIAL

[75] Inventor: Tomas Richter, State College, Pa.

[73] Assignee: American Iron and Steel Institute, Washington, D.C.

[21] Appl. No.: 593,285

[22] Filed: Jan. 29, 1996

[51] Int. Cl.[6] ..... C21C 5/42

[52] U.S. Cl. ..... 222/590; 222/594; 266/237

[58] Field of Search ..... 222/594, 593, 222/590, 591; 266/45, 237

[56] References Cited

U.S. PATENT DOCUMENTS

| | | | |
|---|---|---|---|
| 3,044,499 | 7/1962 | Frerich | 138/143 |
| 3,495,630 | 2/1970 | Hansen et al. | 138/149 |
| 3,801,083 | 4/1974 | Mantey et al. | 266/38 |
| 4,356,994 | 11/1982 | Thornton | 249/109 |
| 4,568,007 | 2/1986 | Fishler | 222/606 |
| 4,776,502 | 10/1988 | Hagenburger et al. | 222/606 |
| 4,842,170 | 6/1989 | Del Vecchio et al. | 266/237 |
| 5,186,886 | 2/1993 | Zerinvary et al. | 266/237 |
| 5,350,159 | 9/1994 | Parker | 266/237 |

*Primary Examiner*—Scott Kastler
*Attorney, Agent, or Firm*—Fitzpatrick, Cella, Harper & Scinto

[57] ABSTRACT

An electromagnetic valve for controlling the flow of molten, magnetic material is provided, which comprises an induction coil for generating a magnetic field in response to an applied alternating electrical current, a housing, and a refractory composite nozzle. The nozzle is comprised of an inner sleeve composed of an erosion resistant refractory material (e.g., a zirconia ceramic) through which molten, magnetic metal flows, a refractory outer shell, and an intermediate compressible refractory material, e.g., unset, high alumina, thermosetting mortar. The compressible refractory material is sandwiched between the inner sleeve and outer shell, and absorbs differential expansion stresses that develop within the nozzle due to extreme thermal gradients. The sandwiched layer of compressible refractory material prevents destructive cracks from developing in the refractory outer shell.

38 Claims, 5 Drawing Sheets

ELECTROMAGNETIC VALVE FOR CONTROLLING THE FLOW OF MOLTEN, MAGNETIC MATERIAL

BACKGROUND OF THE INVENTION

This invention concerns an electromagnetic valve for controlling the flow of molten, magnetic metal, e.g., the flow of molten steel exiting a tundish used in a continuous casting system. The Government of the United States of America has rights in this invention pursuant to Cooperative Agreement No. DE-FC07-93ID13205 awarded by the U.S. Department of Energy.

Ceramic nozzles for modulating the flow of metal are well known in the art. Ceramic nozzles are part of the flow control systems usually complemented with a sliding gate, stopper rod, or chill plug. When such nozzles are used in connection with a steel casting process, the flow of liquid steel through the nozzle is temporarily stopped, for example, by the use of a copper chill plug that is inserted into the nozzle opening from below. The copper chill plug locally freezes the molten steel within the nozzle, creating a solid plug of metal which prevents the molten steel above from flowing through the nozzle. To "restart" the liquid steel flow, an operator located below the nozzle inserts a hot lance into the bore of the nozzle and melts away the solid plug of steel created by the copper chill plug. However, the use of a lance within the nozzle opening can erode the ceramic material. Consequently, such nozzles have to be replaced on a frequent basis, resulting in lost production time and added cost (See U.S. Pat. No. 5,186,886).

To avoid this problem, electromagnetic valve control of liquid metal flow has been developed. By using an electromagnetic valve, liquid metal flow can be restarted without the use of a lance, by inductively heating the solidified metal in the bore of the nozzle to a sufficiently high temperature. The electromagnetic valve contains an induction coil that surrounds a ceramic nozzle. By passing an alternating electric current through the induction coil, the solidified metal in the bore of the nozzle can be heated to a high enough temperature that the metal reaches its melting point. Consequently, the flow of liquid metal can be re-established.

Prior to development of the electromagnetic valve, the flow rate of the casting operation was regulated by altering the level of molten metal in a tundish located above a ceramic metering valve, or by the use of a sliding gate or stopper rod. The flow rate of molten metal through such valves is a function of the cross sectional area of the opening of the valve and the height of molten metal above the valve. Because of variations in the level of molten metal within the tundish, accurate control of the flow can be difficult to achieve.

Electromagnetic valves overcome the above-mentioned problem and are useful for accurately controlling the flow rate of molten metal in open-pour casting, as well as in other high quality casting procedures. The induction coil provided within the electromagnetic valve creates an electromagnetic field with a specific frequency in response to an applied a/c current. The resulting magnetic field is capable of accurately controlling the flow rate through the valve of any molten metal with magnetic properties. The stronger the magnetic field, the slower the flow rate. Unlike prior art valves, the electromagnetic valve provides a more accurate method of controlling the flow rate of molten metal in continuous casting methods.

However, ceramic nozzles used in connection with electromagnetic valves have a tendency to crack, due to thermal expansion stresses present during the initial flow of molten metal, as well as the thermal gradient stresses generated by the close proximity of the cooling systems of the induction coil. During initial flow of molten metal through any refractory nozzle, large temperature gradients develop throughout the entire nozzle. In the case of the electromagnetic valve, the temperature gradients are larger and persist throughout the entire casting operation because of the proximity of the cooling systems of the induction coil. In one-component ceramic nozzles used in connection with an electromagnetic valve, the thermal expansion stresses that develop within the nozzle wall often cause destructive cracks to form. In U.S. Pat. No. 5,186,886 to Zerinvary et al., a two-component composite nozzle is described that includes an inner nozzle sleeve and an outer nozzle shell. The outer nozzle shell contains, and closely engages, the inner nozzle sleeve. The outer nozzle shell applies a compressive load to the inner nozzle sleeve upon the initial flow of molten metal through the nozzle, counteracting the thermally induced tensile stresses, and tending to prevent cracking of the inner nozzle sleeve.

However, the two-component composite nozzle suffers from the limitation that differential thermal expansion throughout the wall of the composite nozzle, induced by the temperature gradient, causes the hot inner sleeve to expand faster and to a greater extent than the cooler outer shell. Consequently, the high stresses generated within the outer shell can exceed the strength of the refractory material, resulting in destructive cracking of the outer shell. Cracks in the outer shell have the potential to develop into fissures that jeopardize the integrity of the entire nozzle.

SUMMARY OF THE INVENTION

The electromagnetic valve of the present invention overcomes the above-mentioned problem by incorporating a composite nozzle design, comprising a refractory inner sleeve positioned inside a refractory outer shell, that minimizes the occurrence of destructive cracking within the nozzle assembly. A separate compressible material is sandwiched between the refractory inner sleeve and the refractory outer shell. The intermediate layer of compressible material thermomechanically separates the inner sleeve and the outer shell and absorbs any excessive differential forces that result from extreme thermal gradients present within the nozzle. The addition of the compressible intermediate layer tends to prevent the refractory outer shell from developing potentially destructive cracks that can develop when stresses within the nozzle exceed the strength of the outer shell material.

The refractory inner sleeve can be composed of any erosion resistant refractory material capable of crack-free operation in a temperature range of about 2700° F. to 2900° F. Preferably, the inner sleeve is composed of a zirconia ceramic.

The refractory inner sleeve preferably has a substantially uniform wall thickness, in the range of about 1 to 15 mm, most preferably in the range of about 3 to 7 mm. Advantageously, the wall thickness of the inner sleeve should not vary by more than +/− 7 mm, most preferably by not more than +/− 5 mm, along the entirety of the sleeve.

The outer shell of the composite nozzle may be composed of any refractory material with either low thermal expansion characteristics (e.g., at least as low as an average of about 0.001% per 1° C.), or relatively high thermal conductivity (e.g., at least as high as approximately k=2 Watt $m^{-1}K^{-1}$ (average value)). Preferably, the refractory material is composed of one or more ceramic compounds selected from the group consisting of mullite, zirconia, corundum, silica, boron nitride, and aluminum nitride, with mullite ceramic being most preferred.

The refractory outer shell can have a wall thickness within the range of about 2 to 35 mm. However, the preferred wall thickness of the outer shell is within the range of about 10 to 25 mm. The thickness of the outer shell does not need to be uniform throughout the entirety of the shell, but may vary within the thickness range just mentioned.

Sandwiched between the refractory inner sleeve and the refractory outer shell is the compressible refractory material. The compressible refractory material can be any refractory material which remains compressible up to or near the operating temperature of the nozzle. Any compressible mortar, mastic, or grout can be used, so long as the material remains plastic within the operating temperature range of the nozzle. An example of a material that meets the above-mentioned requirement is a heat-setting refractory, meaning that the refractory material "sets"—i.e., becomes rigid—at a specific temperature. Upon setting, the sandwiched refractory material becomes irreversibly rigid. Consequently, nozzles incorporating such a material can only be used for one continuous casting run. Such a run might continue for as long as 24 hours, and it is believed that during the run the valve nozzle might be plugged and reopened as many as 10 times, without destruction of the nozzle, when constructed according to the present invention. For the present invention, the setting temperature of the compressible-refractory material is preferably within the range of about 2600° F. to 2700° F.

The material sandwiched between the inner and outer shell is preferably compressible through substantially the entire temperature range of about 70° F. to 2600° F. Its degree of compressibility is preferably at least equal to the thermal expansion of the inner sleeve. Preferably the material is an unset mortar, mastic, or grout comprised of one or more ceramic ingredients selected from the group consisting of mullite, silica, zirconia, zircon, alumina, and alumina magnesia spinel. In the most preferred embodiment, the compressible refractory material is composed of unset, high alumina, heat setting mortar.

The thickness of the layer of compressible refractory material is preferably within the range of about 0.1 to 3 mm. Most preferably, the thickness is in the range of about 1 to 2 mm.

In another aspect, the present invention relates to a process of controlling the flow of molten, magnetic material using the aforedescribed electromagnetic valve. The process includes providing the electromagnetic valve for controlling the flow of molten, magnetic material, and applying an alternating current through the induction coil at a specific frequency surrounding the composite refractory nozzle, so as to adjust the flow rate.

DETAILED DESCRIPTION OF THE PREFERRED EMBODIMENT

Figure 1:
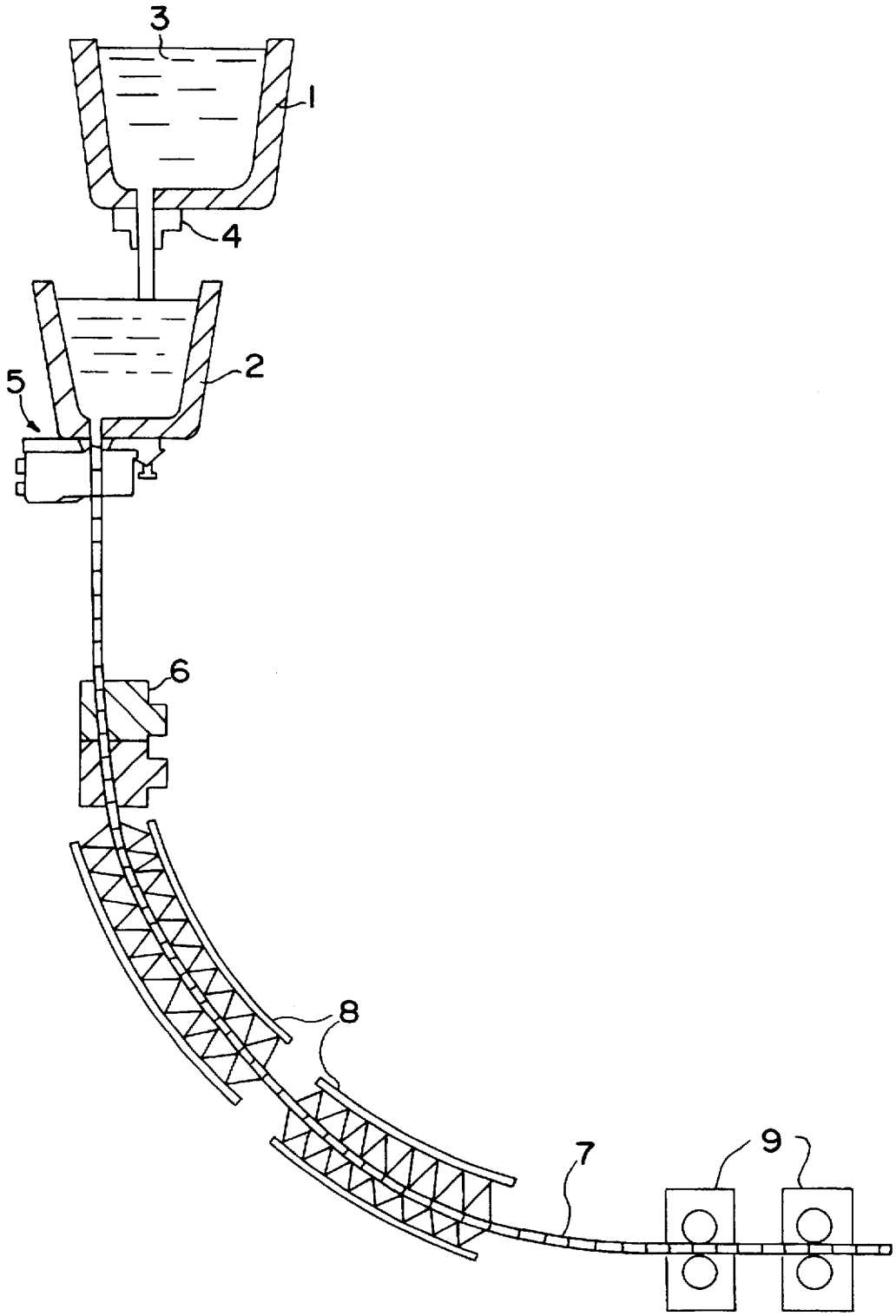
FIG. 1 is a schematic diagram of a continuous casting system, illustrating the use of an electromagnetic valve.

FIG. 1 illustrates a continuous casting system that can benefit from use of the present electromagnetic valve. The continuous casting system includes a ladle container 1 acting as a reservoir for the lower tundish 2. Ladle container 1 replenishes tundish 2 with molten steel 3 on an intermittent basis via a slide gate assembly 4 located on the bottom of the ladle container 1. Located on the bottom of tundish 2 is an electromagnetic valve 5 containing a refractory nozzle (not shown) used to regulate the flow of molten steel into molds 6. The electromagnetic valve 5 is used to provide a flow rate of molten steel equivalent to the rate at which the resulting steel bar 7 can be chilled. The continuous casting system also includes spray assemblies 8 for chilling the newly cast steel bar 7 exiting mold 6. Also provided is straightening assembly 9 for straightening the continuously exiting steel bars.

Figure 2:
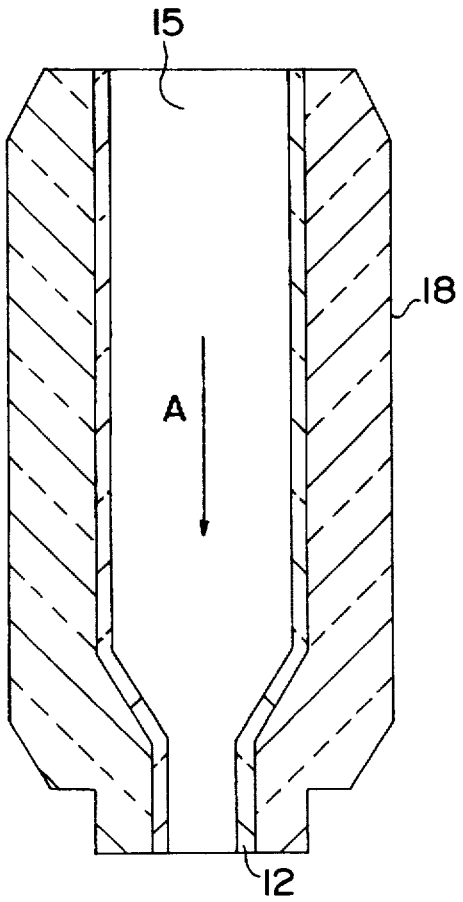
FIG. 2 PRIOR ART
FIG. 2 is an axial cross-sectional view of a prior art two-component refractory nozzle.

FIG. 2 is an axial cross-sectional view of a type of nozzle used in the prior art within the electromagnetic valve 5 shown in FIG. 1. The prior art nozzle includes an inner nozzle sleeve 12 composed of an erosion resistant ceramic material that has a thermal coefficient of expansion similar to zirconia, and an outer nozzle shell 18 composed of a ceramic material that has a higher tensile strength than the inner nozzle sleeve, e.g. boron nitride.

The outer nozzle shell 18 of the prior art nozzle is complementary in shape to the outer wall of inner nozzle sleeve 12. The outer shell 18 is tightly secured to inner sleeve 12 through a thin layer of heat resistant mortar placed on the exterior surface of the inner sleeve 12. A tight securement is thus provided between the inner nozzle sleeve 12 and the outer nozzle shell 18, such that during the initial flow of molten steel through the FIG. 2 nozzle, the surrounding outer shell 18 provides stress-relieving compressive support to the inner sleeve 12. However, the thin layer of mortar used in the prior art nozzle is not compressible, and consequently is not capable of absorbing any excessive differential expansion stresses that develop within the nozzle.

During initial flow of molten steel in the direction of arrow A through the interior portion 15 of the prior art nozzle, large thermal gradients develop throughout the wall of the nozzle. As a result, the hotter inner sleeve 12 undergoes thermal expansion at a faster rate and to a greater extent than the cooler outer nozzle shell 18. Consequently, the internal stresses within the outer nozzle shell 18 can exceed the strength of the shell material, resulting in destructive cracking of the outer shell.

Figure 3:
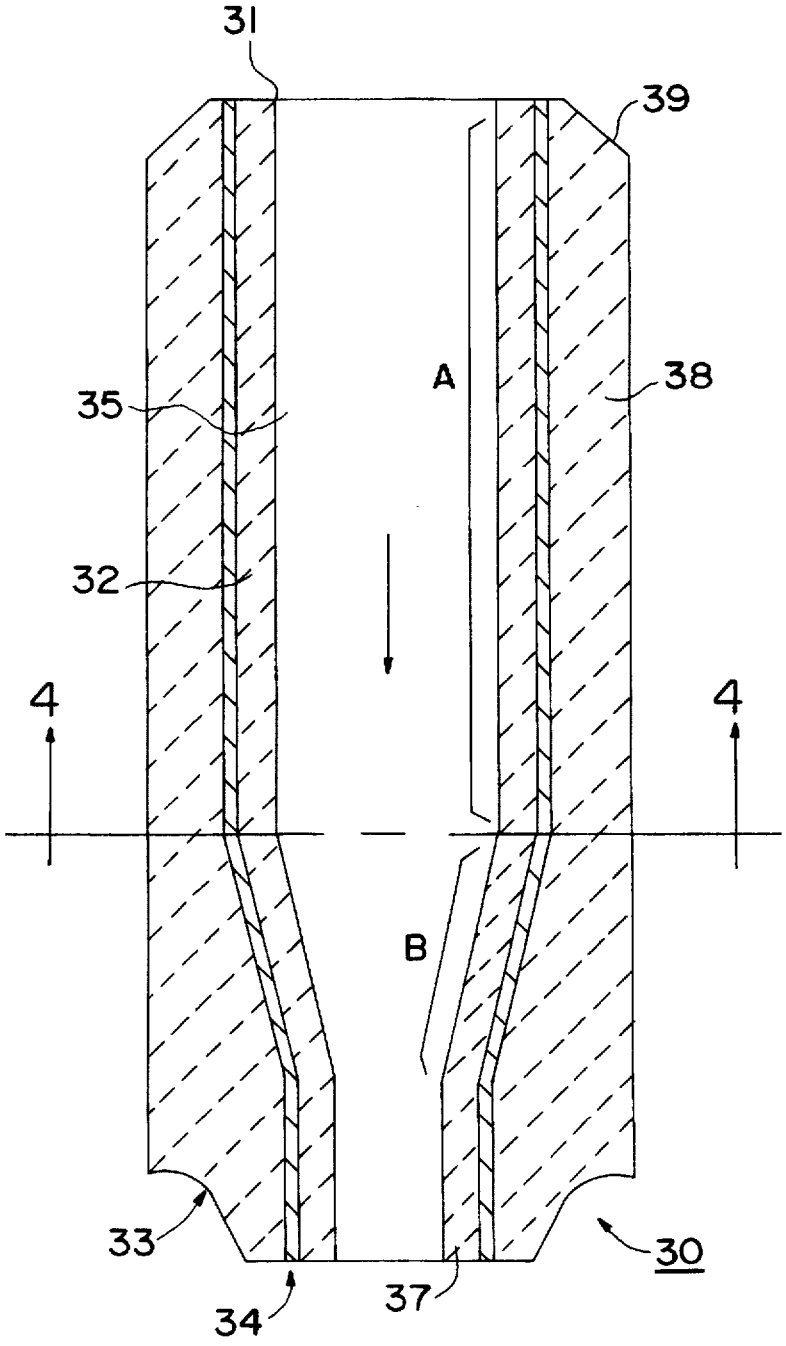
FIG. 3 is an axial cross-sectional side view of the composite nozzle used in the valve of the present invention.
Figure 5:
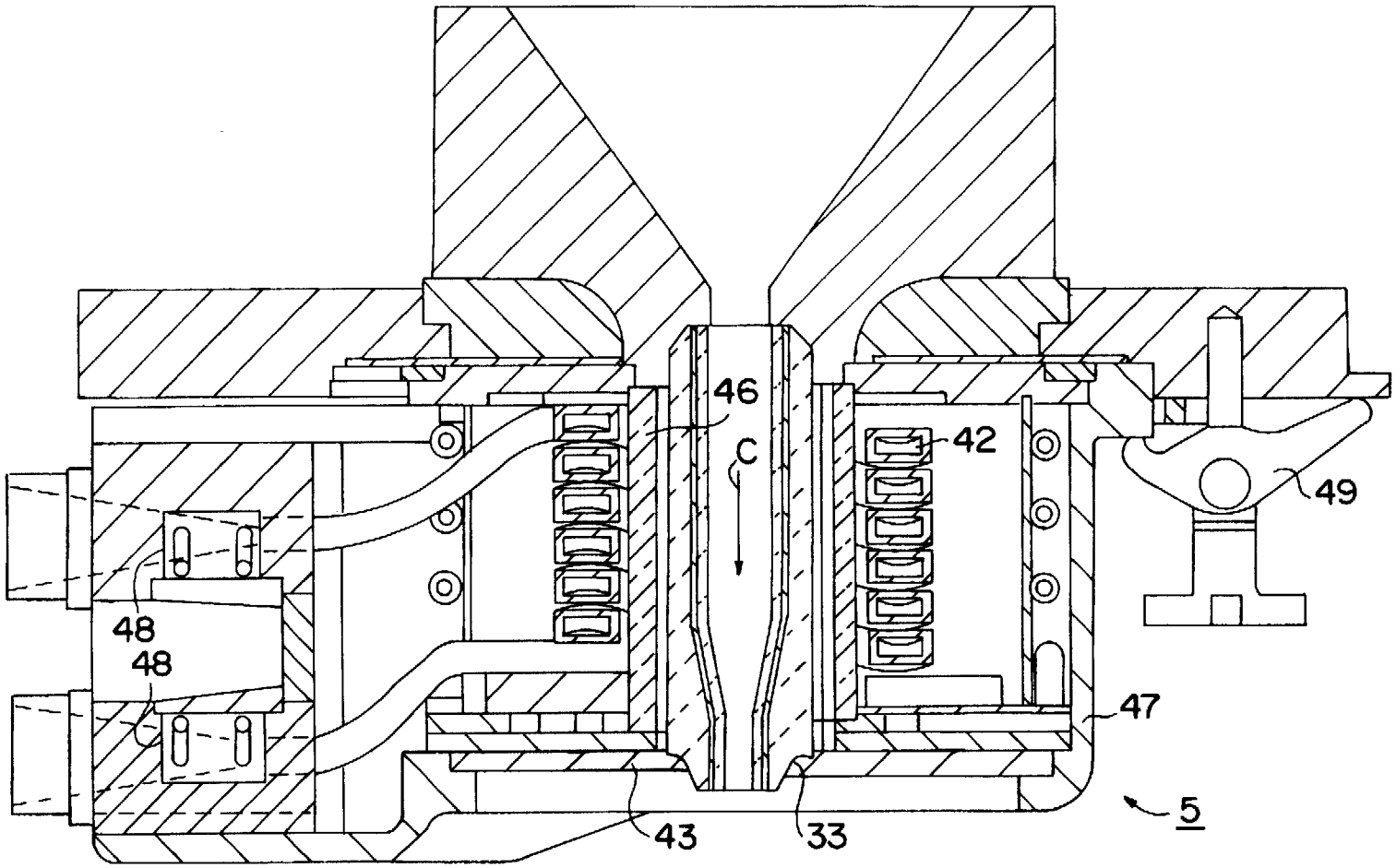
FIG. 5 is a cross-sectional side view of the type of an electromagnetic valve of the present invention.

FIG. 3 illustrates an axial cross sectional view of a refractory composite nozzle 30 which is capable of remedying the above-mentioned problem associated with the prior art design. The nozzle shown in FIG. 3 includes a refractory inner sleeve 32 composed of erosion resistant material, an outer shell 38 composed of refractory material, and an intermediate layer of compressible refractory material 34 sandwiched between the inner sleeve 32 and the outer shell 38. FIG. 5 shows the above-described nozzle in use with an electromagnetic valve.

Figure 4:
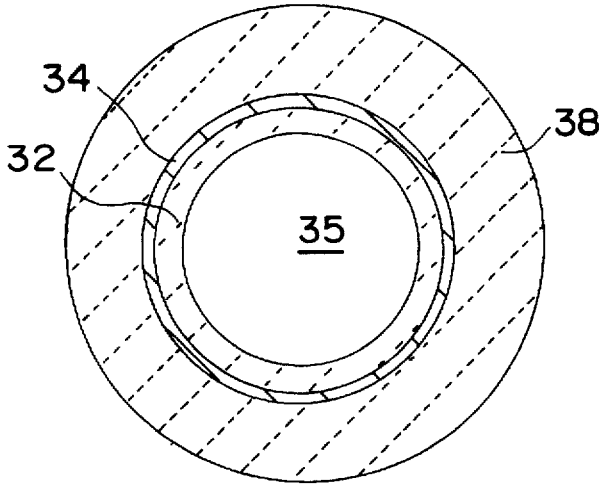
FIG. 4 is an enlarged radial cross-sectional view of the composite nozzle used in the valve of the present invention, taken along the line 4—4 in FIG. 3.

FIG. 4 illustrates a radial cross-sectional view of the refractory composite nozzle along the line 4—4 of FIG. 3. The refractory inner sleeve 32 comprises the innermost layer of the nozzle. A compressible refractory material 34 is disposed on the exterior surface of the inner sleeve 32 and is in substantial contact with the interior surface of refractory outer shell 38. Outer shell 38 is the outermost layer of the composite nozzle and both surrounds and is in substantial contact with the compressible refractory material 34. There are substantially no areas where outer shell 38 directly contacts inner sleeve 32. Molten steel flows through the interior of the nozzle 35.

The electromagnetic valve 5, as illustrated in FIG. 5, contains a spiral shaped induction coil 42 that circumscribes the composite nozzle. The induction coil 42 closely circumscribes a cylindrical alumina safety liner 46 that surrounds the composite nozzle. Induction coil 42 contains a pair of terminal leads 48 that connect to a power source (not shown) that provides the alternating electric current for creating a magnetic field within the composite nozzle. A tapered portion 33 of the composite nozzle extends through an aperture of a steel plate 43 for supporting the composite nozzle within the electromagnetic valve 5. A bucket shaped alumina housing 47, which surrounds the electromagnetic valve 5, attaches to the bottom of a tundish 2 by a plurality of clamps 49 (only one shown).

As shown in FIG. 1, the electromagnetic valve 5 can be used in association with a tundish 2 for modulating the flow of molten steel. FIG. 1 illustrates one electromagnetic valve 5 located on the bottom of a tundish 2. Additional electromagnetic valves may be added to the bottom of tundish 2. The flow of molten steel through the composite nozzle can be temporarily stopped, for example, by the use of a copper chill plug (not shown). Copper chill plugs are commonly used in the art to stop the flow of molten steel in both traditional ceramic nozzles and those used in conjunction with electromagnetic valves. (See U.S. Pat. No. 5,186,866).

To restart the flow through the composite nozzle of the present embodiment, a/c current is passed through the induction coil 42. The induction coil 42 then heats the composite nozzle and the solidified steel contained therein to a temperature in the range of about 2700° F. to 2800° F., whereby the solidified steel within the interior of the composite nozzle undergoes a phase change from solid to liquid. Consequently, the flow of molten steel in the direction of arrow C can be re-established through the nozzle. Restarting liquid flow within the composite nozzle can be accomplished in a matter of seconds, without the need of destructive lancing.

In addition, during flow of molten steel through the interior of the composite nozzle, an alternating electric current is passed through induction coil 42. The resulting electromagnetic field generated can accurately control the flow rate of molten steel within the nozzle. By increasing the a/c current through induction coil 42 the flow of any magnetic material through the nozzle can be slowed. Altering the frequency of the applied a/c current affects the flow rate as well. This system constitutes an improvement over traditional techniques that control the flow rate in continuous casting operations by regulating the level of molten steel in tundish 2, or through the use of either a sliding gate or stopper rod. The electromagnetic valve 5 provides a more accurate way of controlling the flow of molten steel 3 from tundish 2, improving the operation of the continuous casting system.

With respect to FIG. 3, during initial flow of molten steel through the interior 35 of the composite nozzle 30, both the inner sleeve 32 and outer shell 38 are subject to destructive thermal expansion forces due to extreme thermal gradients present throughout the nozzle 30. Similar extreme thermal gradients are present throughout the entire casting operation due to the proximity of cooling systems of induction coil 42. Consequently, both inner sleeve 32 and outer shell 38 are subject to destructive thermal expansion forces throughout the entire casting process.

The layer of sandwiched compressible material 34 between the inner sleeve 32 and the outer shell 38 absorbs any excessive differential expansion stresses that develop throughout the composite nozzle 30, thereby preventing the formation of destructive cracks in the outer shell 38. The compressible material 34 is composed of a refractory heat setting mortar that remains compressible throughout the temperature range of about 70° F. to 2600° F. Preferably, the compressible heat setting mortar used is unset, high alumina, heat setting mortar. One suitable unset, high alumina, heat setting mortar is TAYCOR 342-D high alumina mortar available from North American Refractories Co. at 3127 Research Drive, State College, Pa. 16801. The TAYCOR 342-D mortar comprises on a dry weight basis of the total composition 96.0% $Al_2O_3$, 3.0% $SiO_2$, 0.1% $Fe_2O_3$, 0.1% CaO and MgO, 0.09% $TiO_2$, and 0.3% alkalies (Na and K based). Water is mixed with the dry TAYCOR 342-D Mortar in roughly a 10% by weight basis. The resulting wet mortar is mixed either by hand or using a conventional mixer. The preferable thickness of the mortar layer within the nozzle is in the range of 1 to 2 mm.

During initial flow of molten steel through the interior 35 of the composite nozzle 30, the inner sleeve 32 undergoes thermal expansion due to the extreme thermal gradients present. The compressible high alumina heat setting mortar 34 disposed in between the inner sleeve 32 and the outer shell 38 thus acts as a buffer, preventing the tensile stresses in the outer shell 38 from exceeding the mechanical strength of the material. Consequently, a crack-free composite nozzle is formed that can be used within an electromagnetic valve.

With reference to FIG. 3, the nozzle inner sleeve 32 is preferably formed of a zirconia ceramic material. One suitable refractory material is Composition 2138 DenZbor™ Nozzle Mix available from Zircoa, Inc. 31501 Solon Road, Solon, Ohio 44139-3526. The Composition 2138 DenZbor Nozzle Mix comprises 97% $ZrO_2$ and 3% MgO, all percentages being by weight of the total composition.

Inner sleeve 32 includes a nozzle inlet portion 31 where the molten steel enters from tundish 2 located above the electromagnetic valve 5. Inner sleeve 32 further comprises a segment A with a constant radial cross-sectional area which is contiguous with a funnel-shaped segment B that circumscribes a nozzle outlet 37. The interior surface of inner sleeve 32 provides a substantially cylindrical path through which molten steel flows. The inner sleeve 32 of the preferred embodiment has a wall thickness in the range of about 3 to 7 mm.

Outer shell 38 circumferentially surrounds and directly contacts the compressible material 34 disposed on the exterior surface of the inner sleeve 32. The outer shell 38 has an inner surface that is substantially complementary in shape to the outer surface of the inner sleeve 32. During assembly of the composite nozzle 30, a layer of the heat setting mortar 34 is applied to the exterior surface of the inner sleeve 32. The heat setting mortar may be applied with a spatula, brush, or the like. After application of the heat-setting mortar, the outer shell 38 is then slipped over the inner sleeve 32.

Outer shell 38 includes a first circumferentially tapered section 39 on the exterior surface thereof that is located near the inlet of the composite nozzle 30. Outer shell 38 also includes a second circumferentially tapered section 33 that is substantially adjacent to the outlet of the composite nozzle 30. This second tapered section 33 extends through an aperture 43 (see FIG. 3) for securing the composite nozzle 30 within the electromagnetic valve 5.

The outer shell 38 of the present embodiment is composed of a mullite ceramic. One suitable material for the outer shell 38 is NARCON 65 CASTABLE mullite, available from North American Refractories Company. The NARCON 65 CASTABLE mullite constitutes 66.7% $Al_2O_3$, 29.9% $SiO_2$, 0.8% $Fe_2O_3$, 1.4% $TiO_2$, 1.1% CaO, and 0.1% $Na_2O$, all percentages being by weight of the total composition.

The thickness of the outer shell 38 may have a non-uniform, variable thickness within the range of 2 to 35 mm. Most preferably however, outer shell 38 has a wall thickness in the range of about 10 to 25 mm.

What is claimed is:

1. An electromagnetic valve for controlling the flow of molten, magnetic material comprising:

a) a housing;

b) a nozzle mounted within said housing, said nozzle being comprised of:

i) a refractory inner sleeve composed of an erosion resistant ceramic material;

ii) a refractory outer shell; and iii) a layer of heat-setting compressible refractory material sandwiched between said refractory inner sleeve and said refractory outer shell, wherein said heat-setting compressible refractory material is compressible through substantially the entire range of about 70° F. to about 2600° F. and has a setting temperature that lies within the range of about 2600° F. to about 2700° F.;

c) an induction coil mounted circumferentially around said nozzle in such an arrangement as to allow an electromagnetic field generated by said induction coil to slow the passage of said magnetic material through said nozzle; and d) means for applying an alternating electric current to said induction coil.

2. An electromagnetic valve as described in claim 1, said refractory inner sleeve having a wall thickness in the range of about 3 to 7 mm.

3. An electromagnetic valve as described in claim 1, said refractory inner sleeve having a wall thickness that does not vary by more than +/− 5 mm along the entirety of said inner sleeve.

4. An electromagnetic valve as described in claim 1, said refractory inner sleeve being composed of zirconia ceramic.

5. A electromagnetic valve as described in claim 1, said refractory outer shell having a wall thickness in the range of about 10 to 25 mm and being composed of a refractory material having either a thermal expansibility at least as low as an average of about 0.001% per 1° C., or a thermal conductivity (k) at least as high as approximately 2 Watt $m^{-1}K^{-1}$ (average value).

6. An electromagnetic valve as described in claim 1, said refractory outer shell being composed of mullite ceramic.

7. An electromagnetic valve as described in claim 1, said layer of heat-setting compressible refractory material having a thickness in the range of about 1 to 2 mm.

8. An electromagnetic valve as described in claim 1, said heat-setting compressible refractory material being composed of unset, high alumina, heat-setting mortar.

9. An electromagnetic valve for controlling the flow of molten, magnetic material comprising:

a) a housing;

b) a composite nozzle mounted within said housing, said composite nozzle being comprised of:

i) an inner sleeve composed of an erosion resistant refractory ceramic material, said inner sleeve having a wall thickness in the range of about 3 to 7 mm;

ii) an outer shell composed of a refractory ceramic material, said outer shell having a wall thickness in the range of about 10 to 25 mm; and iii) a layer of heat-setting compressible refractory material sandwiched between said inner sleeve and said outer shell, said heat-setting compressible refractory material having a thickness in the range of about 1 to 2 mm, wherein said heat-setting compressible refractory material is compressible through substantially the entire range of about 70° F. to about 2600° F. and has a setting temperature that lies within the range of about 2600° F. to about 2700° F.;

c) an induction coil mounted circumferentially around said composite nozzle in such an arrangement as to allow an electromagnetic field generated by said induction coil to slow the passage of said magnetic material through said composite nozzle; and d) means for applying an alternating electric current to said induction coil.

10. An electromagnetic valve as described in claim 9, said inner sleeve being composed of zirconia ceramic.

11. An electromagnetic valve as described in claim 9, said outer shell being composed of mullite ceramic.

12. An electromagnetic valve as described in claim 10, said heat-setting compressible refractory material being composed of unset, high alumina, heat-setting mortar.

13. An electromagnetic valve for controlling the flow of molten, magnetic material comprising:

a) a housing;

b) a nozzle mounted within said housing, said nozzle being comprised of:

i) a refractory inner sleeve composed of zirconia ceramic having a wall thickness in the range of about 3 to 7 mm, wherein said refractory inner sleeve is subject to destructive mechanical forces due to thermal gradients present within said refractory nozzle;

ii) a refractory outer shell composed of mullite ceramic having a wall thickness in the range of about 10 to 25 mm; and iii) a layer of heat-setting compressible refractory material composed of unset, high alumina, heat-setting mortar having a thickness in the range of about 1 to 2 mm, wherein said heat-setting compressible refractory material is sandwiched between said refractory inner sleeve and said refractory outer shell, is compressible through substantially the entire range of about 70° F. to about 2600° F. and has a setting temperature that lies within the range of about 2600° F. to about 2700° F.;

c) an induction coil mounted circumferentially around said nozzle in such an arrangement as to allow an electromagnetic field generated by said induction coil to slow the passage of said magnetic material through said nozzle; and d) means for applying an alternating electric current to said induction coil.

14. An electromagnetic valve for controlling the flow of molten steel comprising:

a) a housing;

b) a nozzle mounted within said housing, said nozzle being comprised of:

i) a refractory inner sleeve composed of zirconia ceramic, said refractory inner sleeve having a wall thickness in the range of about 3 to 7 mm, said inner sleeve also having a wall thickness that does not vary by more than +/− 5 mm along the entirety of said inner sleeve;

ii) a refractory outer shell composed of mullite ceramic, said refractory outer shell having a wall thickness in the range of about 10 to 25 mm; and iii) a layer of heat-setting compressible refractory material sandwiched between said refractory inner sleeve and said refractory outer shell, wherein said heat-setting compressible refractory material is composed of unset, high alumina, heat-setting mortar having a thickness in the range of about 1 to 2 mm, is compressible through substantially the entire range of about 70° F. to about 2600° F. and has a setting temperature that lies within the range of about 2600° F. to about 2700° F.;

c) an induction coil mounted circumferentially around said nozzle in such an arrangement as to allow an electromagnetic field generated by said induction coil to slow the passage of said molten steel through said nozzle; and d) means for applying an alternating electric current to said induction coil.

15. An electromagnetic valve for controlling the flow of molten, magnetic material comprising:

a) a housing;

b) a nozzle mounted within said housing, said nozzle being comprised of:

i) a refractory inner sleeve composed of zirconia ceramic having a wall thickness in the range of about 3 to 7 mm;

ii) a refractory outer shell composed of mullite ceramic having a wall thickness in the range of about 10 to 25 mm; and iii) a layer of heat-setting compressible refractory material composed of unset, high alumina, heat-setting mortar having a thickness in the range of about 1 to 2 mm, wherein said heat-setting compressible refractory material is sandwiched between said refractory inner sleeve and said refractory outer shell, is compressible through substantially the entire range of about 70° F. to about 2600° F. and has a setting temperature that lies within the range of about 2600° F. to about 2700° F.;

c) an induction coil mounted circumferentially around said nozzle in such an arrangement as to allow an electromagnetic field generated by said induction coil to slow the passage of said magnetic material through said nozzle; and d) means for applying an alternating electric current to said induction coil.

16. An electromagnetic valve for controlling the flow of molten, magnetic material comprising:

a) a housing;

b) a nozzle mounted within said housing, said nozzle being comprised of:

i) a refractory inner sleeve composed of zirconia ceramic having both an inner and outer surface;

ii) a layer of heat-setting compressible refractory material composed of unset, high alumina, heat-setting mortar surrounding and in contact with said refractory inner sleeve on the outer surface of said sleeve, wherein said heat-setting compressible refractory material is compressible through substantially the entire range of about 70° F. to about 2600° F. and has a setting temperature that lies within the range of about 2600° F. to about 2700° F.; and iii) a refractory outer shell composed of mullite ceramic and having both an inner and outer surface, said outer shell surrounding said layer of heat-setting compressible refractory material, whereby the inner surface of said shell is in substantial contact with said layer of compressible refractory material;

c) an induction coil mounted circumferentially around said nozzle in such an arrangement as to allow an electromagnetic field generated by said induction coil to slow the passage of said magnetic material through said nozzle; and d) means for applying an alternating electric current to said induction coil.

17. An electromagnetic valve as described in claim 16, said refractory inner sleeve having a wall thickness between the inner and outer surface thereof within the range of about 3 to 7 mm.

18. An electromagnetic valve as described in claim 16, said layer of heat-setting compressible refractory material having a thickness within the range of about 1 to 2 mm.

19. An electromagnetic valve as described in claim 16, said refractory outer shell having a wall thickness between the inner and outer surface thereof in the range of about 10 to 25 mm and being composed of a refractory material having either a thermal expansibility at least as low as an average of about 0.001% per 1° C., or a thermal conductivity (k) at least as high as approximately 2 Watt $m^{-1}K^{-1}$ (average value).

20. A process of controlling the flow of molten, magnetic material in a continuous casting system comprising the steps of:

a) first applying an alternating electric current to an induction coil mounted within an electromagnetic valve to initiate gravitational flow of liquid magnetic material through said electromagnetic valve; said electromagnetic valve comprising:

i) a housing;

ii) a nozzle mounted within said housing, said nozzle being comprised of:

1) a refractory inner sleeve composed of an erosion resistant ceramic material;

2) a refractory outer shell; and 3) a layer of heat-setting compressible refractory material sandwiched between said refractory inner sleeve and said refractory outer shell, wherein said heat-setting compressible refractory material is compressible through substantially the entire range of about 70° F. to about 2600° F. and has a setting temperature that lies within the range of about 2600° F. to about 2700° F.;

iii) an induction coil mounted circumferentially around said nozzle in such an arrangement as to allow an electromagnetic field generated by said induction coil to slow the passage of said magnetic material through said nozzle; and iv) means for applying an alternating electric current to said induction coil; and b) then varying the electric current applied to said induction coil to regulate the flow of said magnetic material through said nozzle.

21. A process of controlling the flow of molten, magnetic material according to claim 20, wherein said heat-setting compressible refractory material is an unset mortar, mastic, or grout comprised of one or more ceramic ingredients selected from the group consisting of mullite, silica, zirconia, zircon, alumina, and alumina magnesia spinel.

22. A process of controlling the flow of molten, magnetic material according to claim 20, said refractory inner sleeve having a wall thickness in the range of about 3 to 7 mm.

23. A process of controlling the flow of molten, magnetic material according to claim 20, said refractory inner sleeve having a wall thickness that does not vary by more than +/– 5 mm along the entirety of said inner sleeve.

24. A process of controlling the flow of molten, magnetic material according to claim 20, said refractory inner sleeve being composed of zirconia ceramic.

25. A process of controlling the flow of molten, magnetic material according to claim 20, said refractory outer shell having a wall thickness in the range of about 10 to 25 mm and being composed of a refractory material having either a thermal expansibility at least as low as an average of about 0.001% per 1° C., or a thermal conductivity (k) at least as high as approximately 2 Watt $m^{-1}K^{-1}$ (average value).

26. A process of controlling the flow of molten, magnetic material according to claim 20, said refractory outer shell being composed of mullite ceramic.

27. A process of controlling the flow of molten, magnetic material according to claim 20, said heat-setting compressible refractory material having a thickness in the range of about 1 to 2 mm.

28. A process of controlling the flow of molten, magnetic material according to claim 20, said heat-setting compressible refractory material being composed of unset, high alumina, heat-setting mortar.

29. A process of controlling the flow of molten steel in a continuous casting system comprising the steps of:

a) first pouring molten steel into a tundish to initiate gravitational flow of liquid steel through an electromagnetic valve, said electromagnetic valve comprising:

i) a housing;

ii) a nozzle mounted within said housing, said nozzle being comprised of:

1) a refractory inner sleeve composed of zirconia ceramic, said refractory inner sleeve having a wall thickness in the range of about 3 to 7 mm, said sleeve having a wall thickness that does not vary by more than +/– 5 mm along the entirety of said inner sleeve;

2) a refractory outer shell composed of mullite ceramic, said refractory outer shell having a wall thickness in the range of about 10 to 25 mm; and 3) a layer of heat-setting compressible refractory material sandwiched between said refractory inner sleeve and said refractory outer shell, wherein said heat-setting compressible refractory material is composed of unset, high alumina, heat-setting mortar having a thickness in the range of about 1 to 2 mm, is compressible through substantially the entire range of about 70° F. to about 2600° F. and has a setting temperature that lies within the range of about 2600° F. to about 2700° F.;

iii) an induction coil mounted circumferentially around said nozzle in such an arrangement as to allow an electromagnetic field generated by said induction coil to slow the passage of said molten steel through said nozzle; and iv) means for applying an alternating electric current to said induction coil; and b) then varying the electric current to said induction coil to regulate the flow of said molten steel through said nozzle.

30. A refractory composite nozzle for use in an electromagnetic valve comprised of:

a refractory inner sleeve composed of an erosion resistant ceramic material;

a refractory outer shell; and a layer of heat-setting compressible refractory material sandwiched between said refractory inner sleeve and said refractory outer shell, wherein said heat-setting compressible refractory material is compressible through substantially the entire range of about 70° F. to about 2600° F. and has a setting temperature that lies within the range of about 2600° F. to about 2700° F.

31. A refractory composite nozzle according to claim 30, wherein said heat-setting compressible refractory material is an unset mortar, mastic, or grout comprised of one or more ceramic ingredients selected from the group consisting of mullite, silica, zirconia, zircon, alumina, and alumina magnesia spinel.

32. A refractory composite nozzle according to claim 31, said refractory inner sleeve having a wall thickness in the range of about 3 to 7 mm.

33. A refractory composite nozzle according to claim 32, said refractory inner sleeve having a wall thickness that does not vary by more than +/– 5 mm along the entirety of said inner sleeve.

34. A refractory composite nozzle according to claim 33, said refractory inner sleeve being composed of zirconia ceramic.

35. A refractory composite nozzle according to claim 34, said refractory outer shell having a wall thickness in the range of about 10 to 25 mm and being composed of a refractory material having either a thermal expansibility at least as low as an average of about 0.00% per 1° C., or a thermal conductivity (k) at least as high as approximately 2 watt $m^{-1}$ $K^{-1}$ (average value).

36. A refractory composite nozzle according to claim 35, said refractory outer shell being composed of mullite ceramic.

37. A refractory composite nozzle according to claim 36, said heat-setting compressible refractory material having a thickness in the range of about 1 to 2 mm.

38. A refractory composite nozzle according to claim 37, said heat-setting compressible refractory material being composed of unset, high alumina, heat-setting mortar.

* * * * *